United States Patent [19]

Stannard

[11] Patent Number: 4,932,546

[45] Date of Patent: Jun. 12, 1990

[54] PRESSURE VESSEL

[75] Inventor: James H. Stannard, Basking Ridge, N.J.

[73] Assignee: Buttes Gas & Oil Co., Houston, Tex.

[21] Appl. No.: 324,019

[22] Filed: Mar. 16, 1989

[51] Int. Cl.[5] ..... B65D 1/24

[52] U.S. Cl. ..... 220/3; 220/22; 220/20.5

[58] Field of Search ..... 220/22, 3, 20.5

[56] References Cited

U.S. PATENT DOCUMENTS

| | | | |
|---|---|---|---|
| 2,727,547 | 12/1955 | Moon, 3rd | 220/21 |
| 2,792,962 | 5/1957 | Granfelt | 220/21 |
| 2,868,360 | 1/1959 | Donkin | 220/21 |
| 3,266,704 | 8/1966 | Deeren | 220/21 |
| 3,645,415 | 2/1972 | Phelps | 220/21 |

*Primary Examiner*—Joseph Man-Fu Moy

*Attorney, Agent, or Firm*—Melvin R. Stidham

[57] ABSTRACT

A container for pressurized fluid has a generally rectangular outer shell with relatively flat partitions across the width thereof forming a plurality of compartments. The opposite inner surfaces of each compartment along the length of the vessel are cylindrical. End closures are sealed around the outer shell and they are dished to leave a space around the partitions to enable flow between the compartments.

3 Claims, 1 Drawing Sheet

PRESSURE VESSEL

BACKGROUND OF THE INVENTION

This invention relates to production of small containers for pressurized fluids. More specifically, it is the purpose of the invention to provide a small tank formed of multiple side-by-side, basically cylindrical lobes merged in a substantially rectangular overall configuration to provide a small tank having both the strength characteristics of a cylindrical tank and the volumetric capacity of a rectangular tank. Relatively large multi-lobed tanks for the transport of pressurized fluids in marine vessels, or for the land storage of such pressurized fluids are shown and described in Secord U.S. Pat. No. 4,182,254 for "Tanks for the Storage and Transport Fluid Media Under Pressure." It would be desirable to extend this basic technology to enable relatively inexpensive and commercially feasible production of small tanks for pressurized fluids, such as for aerosol dispensers, portable tools and appliances and the like.

It is generally accepted knowledge that the hoop forces generated in a thin walled cylindrical vessel, as a result of internal pressure, are always tensile and tangential, and that the hoop stress in the wall of a cylindrical tank under pressure is proportional to the internal pressure, as well as to the radius of curvature of the cylindrical vessel.

Of course, in the case of a rectangular vessel with planar surfaces, the radius of curvature is infinite and, therefore, the stress is also infinite, even at a very low internal pressure. In actual practice, there is some deflection of the flat surface and the stress is actually finite. However, it is of considerable magnitude, and the ability of a rectangular vessel, or any vessel with flat walls, to withstand internal pressure is minimal. Therefore, tanks for the storage and/or transportation of pressurized fluids are generally made cylindrical or spherical. The multi-lobed vessel illustrated and described in the aforesaid U.S. Pat. No. 4,182,254 provides a means of approaching the volumetric economy of a rectangular tank, while limiting the working stresses of the vessel to that of a cylindrical tank with a modes radius of curvature.

However, the particular pressure vessel illustrated in U.S. Pat. No. 4,182,254 is fabricated by welding plates to X-inserts and Y-inserts and the lobes must be large enough to enable the welder and the inspector to enter them and have sufficient room to perform their respective tasks while inside. In my co-pending application for U.S. Patent Ser. No. 07/324,020 filed Mar. 16, 1989 for "Fabricated Pressure Vessel" there is illustrated and described a small pressure vessel, such as an automotive fuel tank, that is fabricated, as by welding, entirely from the outside.

OBJECTS OF THE INVENTION

It is an object of this invention to provide a small tank for pressurized fluid, which can be produced without welding.

It is a further object of this invention to provide a small, easily transported tank which is capable of accommodating fluids under pressure.

It is a further object of this invention to permit the reliable and economic production of small, multi-lobed tanks to accommodate fluids under pressure.

It is a further object of this invention to facilitate the fabrication of small multi-lobed tanks wherein major components may be molded or extruded of metal or plastic.

It is a further object of this invention to provide a small multi-lobed tank comprising easily assembled and sealed extruded components.

Other objects and advantages of this invention will become apparent from the description to follow, particularly when read in conjunction with the accompanying drawing.

SUMMARY OF THE INVENTION

In carrying out this invention, I provide a small pressure vessel wherein the main body in extruded or cast in one piece from metal or plastic. The main body comprises a side by side series of generally cylindrical compartments or passageways, which are separated by integral, generally planar septa. The extruded body may be cut to a desired length and the ends are closed by preformed, dished end closure. The dished configuration of the end closures provides some clearance around the ends of the septa to enable fluid communication between the compartments. The exterior configuration of the pressure vessel is of little significance and the tank gains its structural integrity largely through the configuration of the inner surfaces. The inner compartments comprise a series of side by side partial cylinders of a given radius of curvature and the centers of curvature of adjacent compartments are spaced apart by a distance equal to the same radius. Where the arcs of curvature intersect, there is a generally planar septum. The inner surface of the two end compartments continue around in a nearly complete cylinder. The outer side surfaces of the small tank may be made flat and parallel to each other or they may be curved as desired to be parallel to the inner surface.

DESCRIPTION OF A PREFERRED EMBODIMENT

Figure 1:
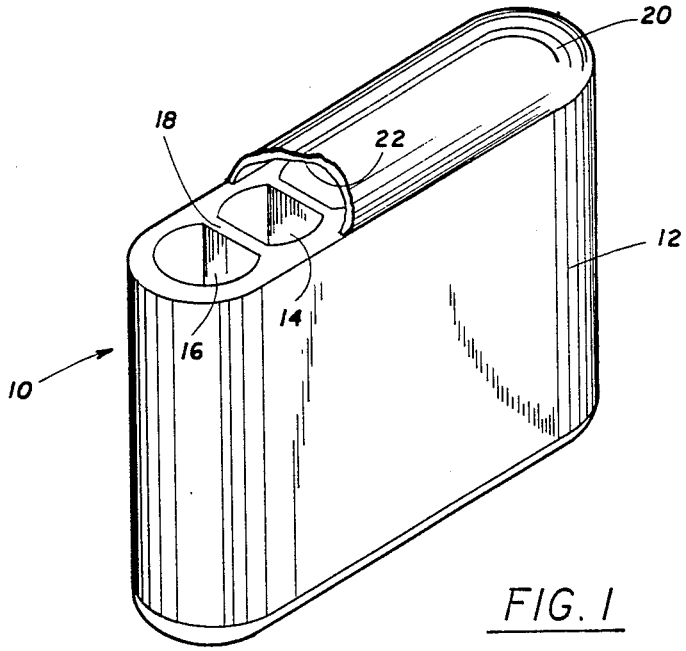
FIG. 1 is a view in perspective partially broken away showing the small pressure tank of this invention.

Referring now to the drawings with greater particularity, the small tank 10 of this invention comprises a one piece main body portion 12 with intermediate part cylinder compartments 14 and two outside compartments 16 that are nearly complete cylinders. The main body may be extruded of suitable metal or plastic with each compartment being separated by a substantially planar septum 18. The main body portion may be formed of substantial length and then cut into lengths desired for completion of the main body portion 12.

Figure 2:
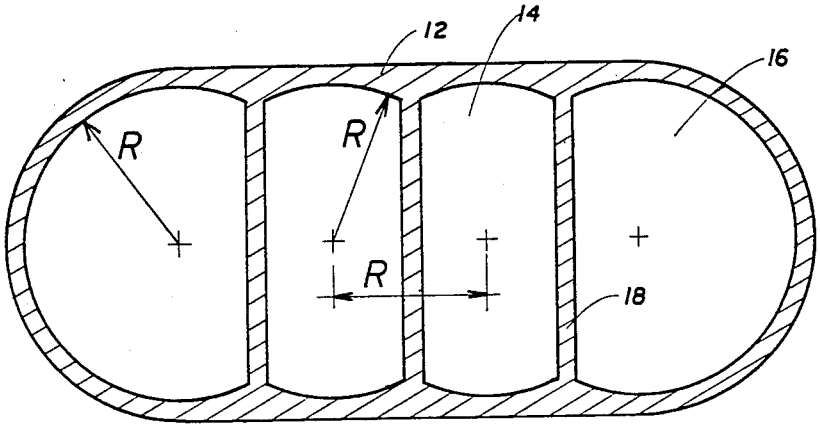
FIG. 2 is a view showing the cross-section of the tank.
Figure 3:
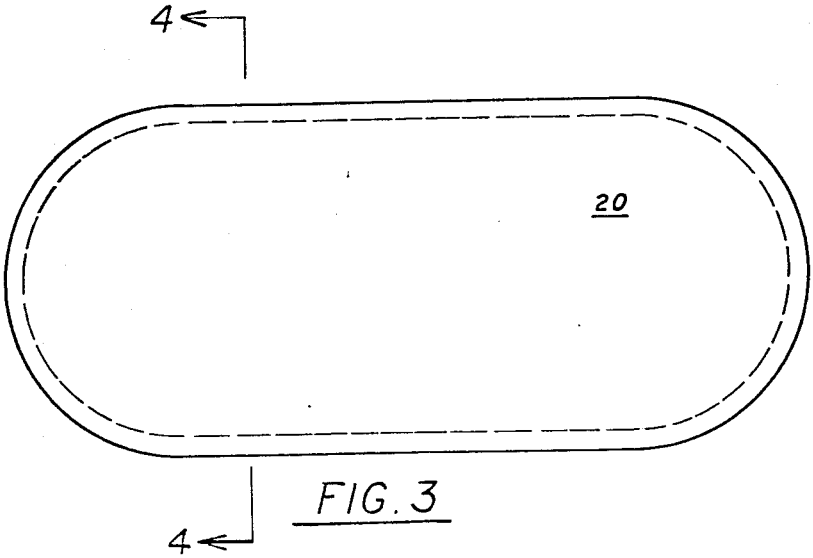
FIG. 3 is a plan view of the tank end closures.
Figure 4:
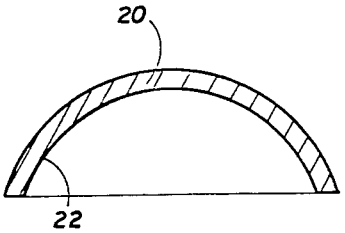
FIG. 4 is a view in section taken along line 4—4 of FIG. 3.

Referring particularly to FIG. 2, the compartments 14 and 16 may be formed with opposing walls of the same radius of curvature R. Further, it has been determined that, with the distance between the centers of curvature also equal to the radius of curvature R, the force imposed on the septum S equals the hoop stress in a cylindrical wall of equal thickness. Of course, in casting or extruding the outer walls, they may be formed flat and, therefore, thicker near the sides of each compartment 14.

Finally, the end closures 20 are preformed, as by stamping or molding and they are formed, as shown, with concave inner surfaces 22. In the case of metal tanks, the end closures may be secured and sealed as by welding or brazing and, in the case of plastic tanks, the end closures can be firmly secured by bonding or by chemical or thermal fusion. In tanks of the size here contemplated, there is generally no need to transfer the end closure longitudinal forces to the septa 18 by extending the septa to the concave inner surfaces. Accordingly, the clearance around the septa provided by the concave inner surface provides fluid communication between the compartments 14 and 16.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed is:

1. A container for pressurized fluid comprising:

a body with a generally rectangular outer shell having top, bottom and side walls and planar end surfaces and having dished end closures sealed to said end surfaces;

at least two integral inperforate partitions joining said top and bottom walls across the width of said shell forming at least two outer compartments and at least one intermediate compartment therein;

the inner surfaces of said outer compartments outward of the outermost partitions being cylindrical, and the opposite internal surfaces of said intermediate compartments between said partitions being partial cylinders; and;

said end closures being dished for greater resistance to internal pressure and to provide flow passageways across said planar end surfaces around said partitions;

at least a portion of said body including at least one said outer compartment and at least one said intermediate compartment being extruded from a single piece of material.

2. The container for pressurized fluid defined by claim 1 wherein: the complete body, including said outer shell and integral partitions, is extruded from a single piece of material.

3. The container for pressurized fluid defined by claim 1 wherein:

there are a plurality of said intermediate compartments;

the opposite internal surfaces of said intermediate compartments having a given radius of curvature; and the centers of curvature of adjacent intermediate compartments being spaced by the length of said radius of curvature.

* * * * *